US010807761B2

(12) United States Patent
Muse et al.

(10) Patent No.: US 10,807,761 B2
(45) Date of Patent: Oct. 20, 2020

(54) FASTENER-FREE PACKAGING

(71) Applicant: Pratt Corrugated Holdings, Inc., Conyers, GA (US)

(72) Inventors: John Richard Muse, Douglasville, GA (US); Shifeng Chen, Newport News, VA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

(21) Appl. No.: 15/909,515

(22) Filed: Mar. 1, 2018

(65) Prior Publication Data

US 2019/0270539 A1 Sep. 5, 2019

(51) Int. Cl.

| | |
|---|---|
| ***B65D 5/10*** | (2006.01) |
| ***B65D 5/468*** | (2006.01) |
| ***B65D 5/42*** | (2006.01) |
| *B31B 110/35* | (2017.01) |
| *B31B 50/26* | (2017.01) |
| *B31B 100/00* | (2017.01) |

(52) U.S. Cl.

CPC ..... *B65D 5/10* (2013.01); *B65D 5/4212* (2013.01); *B65D 5/4608* (2013.01); *B31B 50/26* (2017.08); *B31B 2100/00* (2017.08); *B31B 2110/35* (2017.08)

(58) Field of Classification Search

CPC ..... B65D 5/10; B65D 5/4212; B65D 5/4608; B65D 5/103

USPC ..... 229/157, 185, 156, 158, 178, 117, 149

See application file for complete search history.

(56) References Cited

U.S. PATENT DOCUMENTS

| | | | | |
|---|---|---|---|---|
| 265,985 | A | 10/1882 | Seabury | |
| 1,701,323 | A | 2/1929 | Fredenhagen | |
| 1,868,996 | A | 7/1932 | Sharp | |
| 2,053,857 | A * | 9/1936 | Weiss | B65D 5/103 229/157 |
| 2,151,733 | A * | 3/1939 | Bonfield | B65D 5/46096 229/117.14 |
| 2,386,905 | A | 10/1945 | Meitzen | |
| 2,389,601 | A | 11/1945 | De Witt | |
| 2,554,004 | A | 5/1951 | Bergstein | |
| 2,899,103 | A | 8/1959 | Ebert | |

(Continued)

FOREIGN PATENT DOCUMENTS

| | | |
|---|---|---|
| EP | 2990196 | 3/2016 |
| FR | 3008685 | 7/2013 |

(Continued)

OTHER PUBLICATIONS

US 8,845,046 B2, 09/2014, Nomura et al. (withdrawn)

(Continued)

*Primary Examiner* — Christopher R Demeree

(74) *Attorney, Agent, or Firm* — Taylor English Duma LLP

(57) ABSTRACT

Fastener-free packaging includes a plurality of main panels, each main panel comprising an upper panel, a central panel, and a lower panel; at least one attaching connection feature located on at least one lower panel; and at least one receiving connection feature located on at least one lower panel, wherein each lower panel is connected to at least two other lower panels by an attaching connection feature connecting to a receiving connection feature such that all lower panels are connected together thereby forming a bottom.

12 Claims, 9 Drawing Sheets

(56) References Cited

U.S. PATENT DOCUMENTS 2,927,720 A 3/1960 Adams
2,934,251 A 4/1960 Kramer
2,969,164 A 1/1961 Morrison
3,096,879 A 7/1963 Schumacher
3,097,782 A 7/1963 Koropatkin et al.
3,182,913 A 5/1965 Brian
3,222,843 A 12/1965 Schneider
3,552,466 A 1/1971 Fairchilds
3,734,336 A 5/1973 Rankow et al.
3,854,650 A 12/1974 Hanaue
4,030,227 A 6/1977 Oftedahl
4,049,188 A 9/1977 Persson
4,068,779 A 1/1978 Canfield
4,091,852 A 5/1978 Jordan et al.
4,294,079 A 10/1981 Benson
4,399,157 A 8/1983 Caporaso
4,418,864 A 12/1983 Neilsen
4,434,890 A 3/1984 Sieck et al.
4,444,821 A 4/1984 Young et al.
4,488,623 A 12/1984 Linnell, II et al.
4,509,645 A 4/1985 Hotta
4,650,112 A 3/1987 Booth
4,884,741 A 12/1989 Nederveld
4,953,782 A 9/1990 Noland
5,016,813 A 5/1991 Simons
5,022,582 A 6/1991 Ritter
5,062,527 A 11/1991 Westerman
5,104,035 A 4/1992 Rosenbaum, II
5,165,583 A 11/1992 Kouwenberg
5,263,339 A 11/1993 Evans
5,418,031 A 5/1995 English
5,441,170 A 8/1995 Bane, III
5,493,874 A 2/1996 Landgrebe
5,499,473 A 3/1996 Ramberg
5,596,880 A 1/1997 Welker et al.
5,996,366 A 12/1999 Renard
6,003,719 A 12/1999 Steward, III
6,164,526 A 12/2000 Dalvey
6,168,040 B1 1/2001 Sautner et al.
6,220,473 B1 4/2001 Lehman et al.
6,238,091 B1 5/2001 Mogil
6,244,458 B1 6/2001 Frysinger et al.
6,247,328 B1 6/2001 Mogil
6,325,281 B1 12/2001 Grogan
6,325,282 B1 12/2001 Kanter et al.
6,343,696 B1 2/2002 McCormick et al.
6,378,733 B1 4/2002 Boonzaier
6,453,682 B1 9/2002 Jennings et al.
6,478,268 B1 11/2002 Bidwell et al.
6,510,705 B1 1/2003 Jackson
6,582,124 B2 6/2003 Mogil
6,618,868 B2 9/2003 Minnick
6,688,133 B1 2/2004 Donefrio
6,725,783 B2 4/2004 Sekino
6,736,309 B1 5/2004 Westerman et al.
6,771,183 B2 8/2004 Hunter
6,821,019 B2 11/2004 Mogil
6,837,420 B2 1/2005 Westerman et al.
6,868,982 B2 3/2005 Gordon
6,875,486 B2 4/2005 Miller
6,899,229 B2 5/2005 Dennison et al.
6,910,582 B2 6/2005 Lantz
6,971,539 B1 12/2005 Abbe
D514,928 S 2/2006 Keberlein
7,000,962 B2 2/2006 Le
7,083,147 B2 8/2006 Movsesian et al.
7,094,192 B2 8/2006 Schoenberger et al.
D542,129 S 5/2007 Moorman
7,225,970 B2 6/2007 Philips
7,229,677 B2 6/2007 Miller
7,392,931 B2 7/2008 Issler
7,422,143 B2 9/2008 Mayer
7,452,316 B2 11/2008 Cals et al.
D582,676 S 12/2008 Rothschild
7,500,593 B2 3/2009 Mayer
7,597,209 B2 10/2009 Rothschild et al.
7,624,911 B2 12/2009 Spurrell et al.
D608,634 S 1/2010 Riedi
7,677,406 B2 3/2010 Maxson
7,681,405 B2 3/2010 Williams
7,807,773 B2 10/2010 Matsuoka et al.
7,841,512 B2 11/2010 Westerman et al.
7,845,508 B2 12/2010 Rothschild et al.
7,870,992 B2 1/2011 Schille et al.
D651,076 S 12/2011 Van Berlo
8,101,259 B2 1/2012 Kuboniwa
8,250,882 B2 8/2012 Mustafa et al.
8,365,943 B2 2/2013 Bentley
8,424,335 B2 4/2013 Corder et al.
8,453,477 B2 6/2013 Crespo et al.
8,613,202 B2 12/2013 Williams
8,728,605 B2 5/2014 Payne et al.
8,763,423 B2 7/2014 Tattam
8,763,811 B2 7/2014 Lantz
8,763,886 B2 7/2014 Hall
8,887,515 B2 11/2014 Patstone
8,919,082 B1 12/2014 Cataldo
8,938,986 B2 1/2015 Matta et al.
9,242,758 B2 1/2016 Brundage et al.
9,550,618 B1 1/2017 Jobe
9,605,382 B2 3/2017 Virtanen
9,751,683 B1 9/2017 Jobe
9,981,797 B2 5/2018 Aksan
10,065,782 B1 * 9/2018 Jones ..... B65D 77/062
10,065,786 B2 9/2018 Kuhn
10,106,290 B2 10/2018 Couture
D834,411 S 11/2018 Vanderhulst et al.
10,266,332 B2 4/2019 Aksan et al.
D874,268 S 2/2020 Muse et al.
10,633,165 B2 4/2020 Aksan et al.
752,425 A1 8/2020 Aksan et al.
2002/0050147 A1 5/2002 Mai et al.
2002/0096559 A1 * 7/2002 Quaintance ..... B65D 5/029 229/109
2004/0004111 A1 * 1/2004 Cardinale ..... B65D 5/0227 229/117.32
2004/0016212 A1 1/2004 Miller
2004/0081727 A1 4/2004 Kelly et al.
2004/0151851 A1 8/2004 Miller
2004/0211825 A1 * 10/2004 Champion ..... B65D 5/3621 229/178
2005/0006446 A1 1/2005 Stafford, Jr.
2005/0159282 A1 7/2005 Schoenberger et al.
2005/0163947 A1 7/2005 Miller
2005/0178142 A1 8/2005 Perry et al.
2005/0224501 A1 10/2005 Folkert et al.
2005/0241978 A1 11/2005 Plue et al.
2006/0003057 A1 1/2006 Kelly et al.
2006/0053828 A1 3/2006 Shallman et al.
2006/0163333 A1 7/2006 Kornacki
2006/0174648 A1 8/2006 Lantz
2007/0051782 A1 3/2007 Lantz
2007/0051783 A1 * 3/2007 Wisecarver ..... B65D 5/029 229/109
2007/0152027 A1 * 7/2007 Hyatt ..... B65D 5/029 229/109
2008/0078819 A1 * 4/2008 Strong ..... B65D 5/029 229/109
2008/0095959 A1 4/2008 Warner et al.
2008/0099492 A1 5/2008 Mayer
2008/0289302 A1 11/2008 Vulpitta
2008/0296356 A1 12/2008 Hatcher et al.
2009/0078708 A1 3/2009 Williams
2009/0193765 A1 8/2009 Lantz
2009/0283578 A1 11/2009 Miller
2010/0072105 A1 3/2010 Glaser et al.
2010/0139878 A1 6/2010 Clemente
2010/0314397 A1 12/2010 Williams et al.
2011/0042449 A1 2/2011 Copenhaver et al.
2011/0100868 A1 5/2011 Lantz
2011/0114513 A1 5/2011 Miller
2011/0127272 A1 6/2011 Crespo et al.
2011/0241514 A1 10/2011 Nomura et al.
2011/0284556 A1 11/2011 Palmer et al.

(56) References Cited

U.S. PATENT DOCUMENTS

| | | | |
|---|---|---|---|
| 2011/0311758 | A1 | 12/2011 | Burns et al. |
| 2012/0145568 | A1 | 6/2012 | Collison et al. |
| 2012/0248101 | A1 | 10/2012 | Tumber et al. |
| 2012/0251818 | A1 | 10/2012 | Axrup et al. |
| 2013/0094791 | A1 | 4/2013 | Aspenson et al. |
| 2013/0055750 | A1 | 5/2013 | Mustafa |
| 2013/0112694 | A1 | 5/2013 | Bentley |
| 2013/0112695 | A1 | 5/2013 | Hall |
| 2013/0140317 | A1 | 6/2013 | Roskoss et al. |
| 2013/0291584 | A1 | 11/2013 | Chapman, Jr. |
| 2014/0000306 | A1 | 1/2014 | Chapman, Jr. |
| 2014/0021208 | A1 | 1/2014 | Anti et al. |
| 2014/0144161 | A1 | 5/2014 | Pointer et al. |
| 2014/0151382 | A1 | 6/2014 | White et al. |
| 2014/0319018 | A1 | 10/2014 | Collison |
| 2014/0353317 | A1 | 12/2014 | Ranade et al. |
| 2014/0367393 | A1 | 12/2014 | Ranade |
| 2015/0068242 | A1 | 3/2015 | Patstone |
| 2016/0304267 | A1 | 10/2016 | Aksan |
| 2016/0325915 | A1 | 11/2016 | Aksan |
| 2017/0225870 | A1 | 8/2017 | Collison |
| 2018/0086539 | A1 | 3/2018 | Aksan et al. |
| 2018/0237207 | A1 | 8/2018 | Aksan et al. |
| 2019/0185248 | A1 | 6/2019 | Aksan et al. |
| 2019/0193917 | A1 | 6/2019 | Aksan et al. |
| 2020/0270052 | A1 | 8/2020 | Aksan et al. |

FOREIGN PATENT DOCUMENTS

| | | | |
|---|---|---|---|
| GB | 1272730 | | 5/1972 |
| JP | 2001018952 | | 1/2001 |
| JP | 5661362 | | 1/2015 |
| WO | 2016187435 | A2 | 5/2016 |
| WO | 2016187435 | A3 | 11/2016 |

OTHER PUBLICATIONS

Aksan, Yavuz; Applicant-Initiated Interview Summary for U.S. Appl. No. 14/703,094, filed May 4, 2015, dated Jan. 16, 2019, 3 pgs.
Aksan, Yavuz; Non-Final Office Action for U.S. Appl. No. 14/703,094, filed May 4, 2015, dated Oct. 30, 2018 13 pgs.
Aksan, Yavuz; Applicant-Initiated Interview Summary for U.S. Appl. No. 14/690,501, filed Apr. 20, 2015, dated Feb. 9, 2017, 7 pgs.
Aksan, Yavuz; Final Office Action for U.S. Appl. No. 14/690,501, filed Apr. 20, 2015, dated Dec. 8, 2016, 18 pgs.
Aksan, Yavuz; Non-Final Office Action for U.S. Appl. No. 14/690,501, filed Apr. 20, 2015, dated Aug. 17, 2016 22 pgs.
Aksan, Yavuz; Non-Final Office Action for U.S. Appl. No. 14/690,501, filed Apr. 20, 2015, dated Aug. 8, 2017, 18 pgs.
Aksan, Yavuz; Notice of Allowability for U.S. Appl. No. 14/690,501, filed Apr. 20, 2015, dated Mar. 28, 2018, 2 pgs.
Aksan, Yavuz; Notice of Allowability for U.S. Appl. No. 14/690,501, filed Apr. 20, 2015, dated Apr. 18, 2018, 6 pgs.
Aksan, Yavuz; Notice of Allowability for U.S. Appl. No. 14/690,501, filed Apr. 20, 2015, dated Apr. 26, 2018, 6 pgs.
Aksan, Yavuz; Notice of Allowance for U.S. Appl. No. 14/690,501, filed Apr. 20, 2015, filed Jan. 31, 2018, 14 pgs.
Aksan, Yavuz; Non-Final Office Action for U.S. Appl. No. 14/703,904, filed May 4, 2015, dated Dec. 29, 2017, 39 pgs.
Aksan, Yavuz; Restriction Requirement for U.S. Appl. No. 14/703,904, filed May 4, 2015, dated Sep. 15, 2017, 7 pgs.
Greenblue; "Environmental Technical Briefs of Common Packaging Materials—Fiber-Based Materials", Sustainable Packaging Solution, 2009, 19 pgs.
MP Global Products; Article entitled: "Thermopod mailer envelopes and Thermokeeper insulated box liners", located at < http://www.mhpn.com/product/thermopod_mailer_envelopes_and_thermokeeper_insulated_box_liners/packaging>, accessed on Aug. 30, 2017, 2 pgs.
UN Packaging; Article entitled: "CooLiner® Insulated Shipping Bags", available at <http://www.chem-tran.com/packaging/supplies/cooliner-insulated-shipping-bags.php>, accessed on Aug. 30, 2017, 2 pgs.
Aksan, Yavuz; Advisory Action for U.S. Appl. No. 14/703,094, filed May 4, 2015, dated Sep. 13, 2018, 3 pgs.
Aksan, Yavuz; Final Office Action for U.S. Appl. No. 14/703,094, filed May 4, 2015, dated Jul. 10, 2018, 25 pgs.
Aksan, Yavuz; Issue Notification for U.S. Appl. No. 14/690,501, filed Apr. 20, 2015, dated May 9, 2018, 1 pg.
Aksan, Yavuz; Issue Notification for U.S. Appl. No. 14/703,094, filed May 4, 2015, dated Apr. 3, 2019, 1 pg.
Aksan, Yavuz; Notice of Allowance for U.S. Appl. No. 14/703,094, filed May 4, 2015, dated Feb. 19, 2019, 13 pgs.
Aksan, Yavuz; Non-Final Office Action for U.S. Appl. No. 15/954,677, filed Apr. 17, 2018, dated Jun. 13, 2019, 45 pgs.
Aksan, Yavuz; Non-Final Office Action for U.S. Appl. No. 16/280,609, filed Feb. 20, 2019, dated Jun. 13, 2019, 28 pgs.
Aksan, Yavuz; Non-Final Office Action for U.S. Appl. No. 15/809,072, filed Nov. 10, 2017, dated Aug. 6, 2019, 47 pgs.
Muse, John Richard; Ex Parte Quayle Action for U.S. Appl. No. 29/646,433, filed May 4, 2018, mailed May 14, 2019, 32 pgs.
Aksan, Yavuz; Final Office Action for U.S. Appl. No. 15/954,677, filed Apr. 17, 2018, dated Nov. 8, 2019, 23 pgs.
Aksan, Yavuz; Applicant-Initiated Interview Summary for U.S. Appl. No. 16/280,609, filed Feb. 20, 2019, dated Oct. 4, 2019, 3 pgs.
Aksan, Yavuz; Final Office Action for U.S. Appl. No. 16/280,609, filed Feb. 20, 2019, dated Sep. 10, 2019, 18 pgs.
Aksan, Yavuz; Non-Final Office Action for U.S. Appl. No. 16/280,609, filed Feb. 20, 2019, dated Nov. 19, 2019, 14 pgs.
Muse, John Richard; Notice of Allowance for U.S. Appl. No. 29/646,433, filed May 4, 2018, dated Sep. 26, 2019, 14 pgs.
Aksan, Yavuz; Non-Final Office Action for U.S. Appl. No. 16/293,868, filed Mar. 6, 2019, dated Feb. 10, 2020, 38 pgs.
Aksan, Yavuz; Final Office Action for U.S. Appl. No. 15/809,072, filed Nov. 10, 2017, dated Jan. 31, 2020, 22 pgs.
Muse, John Richard; Corrected Notice of Allowance for U.S. Appl. No. 29/646,433, filed May 4, 2018, dated Dec. 9, 2019, 7 pgs.
Aksan, Yavuz; Notice of Allowance for U.S. Appl. No. 15/954,677, filed Apr. 17, 2018, dated Mar. 31, 2020, 20 pgs.
Aksan, Yavuz; Notice of Allowance for U.S. Appl. No. 16/280,609, filed Feb. 20, 2019, dated Mar. 13, 2020, 18 pgs.
Aksan, Yavuz; Final Office Action for U.S. Appl. No. 16/293,868, filed Mar. 6, 2019, dated May 13, 2020, 14 pgs.
Aksan, Yavuz; Non-Final Office Action for U.S. Appl. No. 15/809,072, filed Nov. 10, 2017, dated Apr. 22, 2020, 25 pgs.
Aksan, Yavuz; Notice of Allowance for U.S. Appl. No. 15/954,677, filed Apr. 17, 2018, dated Jul. 23, 2020, 6 pgs.
Aksan, Yavuz; Supplemental Notice of Allowance for U.S. Appl. No. 15/954,677, filed Apr. 17, 2018, dated Mar. 12, 2020, 6 pgs.
Aksan, Yavuz; Non-Final Office Action for US. Appl. No. 16/293,868, filed Mar. 6, 2019, dated Jul. 1, 2020, 15 pgs.

* cited by examiner

FASTENER-FREE PACKAGING

TECHNICAL FIELD

This disclosure relates to packaging. More specifically, this disclosure relates to simplified packaging solutions.

BACKGROUND

Packaging, and boxes in particular, can be formed from various materials with various structural considerations. Typically, packaging can require mechanical fasteners—such as tape—to maintain structural integrity of the packaging and securing contents.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a blank for forming packaging including a first main panel; a second main panel connected to the first main panel; a third main panel connected to the second main panel; a fourth main panel connected to the second main panel; and a connection panel connected to the fourth main panel, each main pain further comprising at least one upper panel, at least one central panel, and at least one lower panel, wherein at least one upper panel comprises an attaching connection feature, wherein at least one lower panel comprises an attaching connection feature, wherein at least one upper panel comprises a receiving connection feature, and wherein at least one lower panel comprises a receiving connection feature.

Also disclosed is a fastener-free box including a plurality of main panels, each main panel comprising an upper panel, a central panel, and a lower panel; at least one attaching connection feature located on at least one lower panel; and at least one receiving connection feature located on at least one lower panel, wherein each lower panel is connected to at least two other lower panels by an attaching connection feature connecting to a receiving connection feature such that all lower panels are connected together thereby forming a bottom.

Also disclosed is a method of forming a box from a blank that includes the steps of obtaining a pre-assembled, flattened blank, the pre-assembled blank comprising: a first main panel; a second main panel connected to the first main panel; a third main panel connected to the second main panel; a fourth main panel connected to the second main panel; and a connection panel connected to the fourth main panel and to the first main panel, each main pain further comprising at least one upper panel, at least one central panel, and at least one lower panel, wherein at least one upper panel comprises an attaching connection feature, wherein at least one lower panel comprises an attaching connection feature, wherein at least one upper panel comprises a receiving connection feature, wherein at least one lower panel comprises a receiving connection feature, wherein an inner surface of the first panel contacts an inner surface of the second panel, and wherein an inner surface of the third panel contacts an inner surface of the fourth panel; expanding the pre-assembled blank to form an expanded structure; forming a bottom of the box, the step of forming the bottom of the box comprising the steps of: arranging each lower panel comprising the receiving connection feature in arrangement covering a bottom end of the expanded structure, arranging each lower panel comprising the attaching connection feature to connect to one receiving connection feature of each of the lower panels comprising the receiving connection feature, and connecting each attaching connection feature to at least one receiving connection feature; and forming a top of the box, the step of forming the top of the box comprising the steps of: arranging each upper panel comprising the receiving connection feature in arrangement covering a top end of the expanded structure, arranging each upper panel comprising the attaching connection feature to connect to one receiving connection feature of each of the upper panels comprising the receiving connection feature, and connecting each attaching connection feature to at least one receiving connection feature. Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
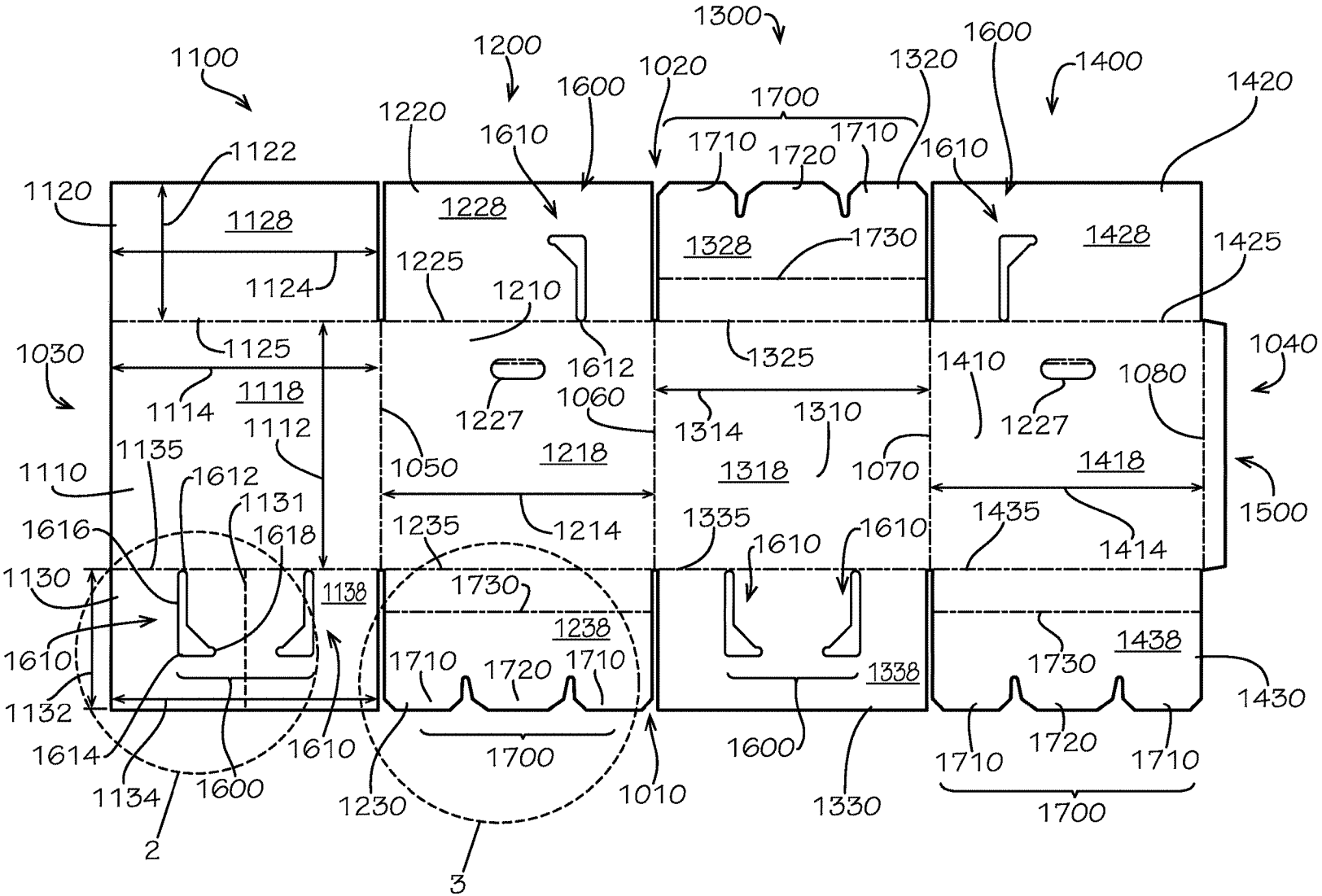
FIG. 1 is a plan view of an inner side of a blank for forming a box in accord with one aspect of the current disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is packaging and a blank formable into packaging, including associated methods, systems, devices, and various apparatus. It would be understood by one of skill in the art that the disclosed packaging is described in but a few exemplary embodiments among many. No particular terminology or description should be considered limiting on the disclosure or the scope of any claims issuing therefrom.

One embodiment of a blank 1000 formable into packaging—such as a box—is disclosed and described with reference to FIG. 1. The blank 1000 can be formed of corrugated cardboard in various aspects, although one of skill in the art would understand that a variety of material compositions can be utilized without straying from the scope of this disclosure. Other materials could include plastics, non-corrugated cardboard, paperboard, and various other materials as would be known or understood in the art. The blank 1000 can comprise four main panels 1100, 1200, 1300, 1400 and a connection panel 1500. The blank 1000 can define a bottom end 1010, a top end 1020, a first lateral end 1030, and a second lateral end 1040. The top end 1020 and the bottom end 1010 can be defined by each of the main panels 1100, 1200, 1300, 1400, and the lateral end 1030 can be defined by panel 1100 on one side and the lateral end 1040 can be defined by the combination of panel 1400 and connection panel 1500 on the other side. The first main panel 1100 can be connected to the second main panel 1200 along score line 1050. Score lines of the current disclosure can include creased regions, perforations, or various other weakened methods to provide a predictable location at which bends or folding can occur. In various aspects, score lines can comprise various methods to achieve predictable bending or folding in a desired direction and location. One of skill in the art would understand that inclusion of various types of score lines known in the art would not depart from the scope of the current disclosure. The second main panel 1200 can be connected to the third main panel 1300 along score line 1060. The third main panel 1300 can be connected to the fourth main panel 1400 along score line 1070. The fourth main panel 1400 can be connected to the connection panel 1500 along score line 1080.

Each main panel 1100, 1200, 1300, 1400 includes various sub-panels. First main panel 1100 can comprise a central panel 1110, an upper panel 1120, and a lower panel 1130. The upper panel 1120 can be connected to the central panel 1110 along a score line 1125, and the lower panel 1130 can be connected to the central panel 1110 along a score line 1135. The second main panel 1200 can comprise a central panel 1210, an upper panel 1220 connected to the central panel 1210 by a score line 1225, and a lower panel 1230 connected to the central panel 1210 by a score line 1235. The third main panel 1300 can comprise a central panel 1310, an upper panel 1320 connected to the central panel 1310 by a score line 1325, and a lower panel 1330 connected to the central panel 1310 by a score line 1335. The fourth main panel 1400 can comprise a central panel 1410, an upper panel 1420 connected to the central panel 1410 by a score line 1425, and a lower panel 1430 connected to the central panel 1410 by a score line 1435. As can be seen, a handle cutout 1227 can be defined in the central panel 1210 as would be understood by one familiar with the art. Additionally, another handle cutout 1227 can be defined in the central panel 1410. In other aspects, the handle cutouts 1227 can be defined in other panels, such as the central panel 1110 and the central panel 1310.

Each main panel 1100, 1200, 1300, 1400 can be about rectangular in shape with various features to the various sub-panels. Each central panel 1110, 1210, 1310, 1410 can be generally rectangular in shape. Central panel 1110 can include a vertical dimension 1112 and a lateral dimension 1114. Central panel 1210 can include a vertical dimension (not shown) and a lateral dimension 1214. Central panel 1310 can include a vertical dimension (not shown) and a lateral dimension 1314. Central panel 1410 can include a vertical dimension (not shown) and a lateral dimension 1414. In the current aspect, the vertical dimensions of the various central panels 1110, 1210, 1310, 1410 can be about the same. In the current aspect, vertical dimensions including vertical dimension 1112 can be about 16.75 inches, although in various aspects may be various dimensions. In the current aspect, lateral dimensions 1114 and 1414 can be about 18 and ⅜ inches while lateral dimensions 1214 and 1314 can be about 18 and 3/16 inches. As previously noted, the material used to form the blank 1000 can be corrugated cardboard. As such, the variation in lateral dimensions 1114, 1214, 1314, 1414 can account for the various thickness of the corrugated cardboard.

The upper panel 1120 of the current aspect can be of a lateral dimension 1124 of about the same as lateral dimension 1114, or, in various aspects, can be slightly less than lateral dimension 1114. The upper panel 1120 can be of a vertical dimension 1122 that is about half of a width of a resultant box 2000 (discussed later in this disclosure) formed from the blank 1000. As a result, the vertical dimension 1122 can be about half of the lateral dimension 1214. In the current aspect, the upper panel 1120 can be devoid of additional features, although in various aspects the upper panel 1120 can be formed with various features as described elsewhere in this disclosure.

The lower panel 1130 of the current aspect can be of a lateral dimension 1134 of about the same as lateral dimension 1114, or, in various aspects, can be slightly less than lateral dimension 1114. The lower panel 1130 can be of a vertical dimension 1132 that is about half of a width of a resultant box 2000 (discussed later in this disclosure) formed from the blank 1000. As a result, the vertical dimension 1132 can be about half of the lateral dimension 1214. In various aspects, the vertical dimension 1132 can be greater than or less than half of the lateral dimension 1214, and, in various aspects, the sum of vertical dimension 1132 and vertical dimension 1122 can be about the same as lateral dimension 1214. In the current aspect, the lower panel 1130 can comprise at least one receiving connection feature 1600. Each receiving connection feature 1600 can provide for connection of various other features of the blank 1000 when formed into a box 2000 (discussed later in this disclosure). In the current aspect, each receiving connection feature 1600 can comprise at least one connection aperture 1610. In the current aspect, each connection aperture 1610 can be defined in the panel in which it is located, specifically in the lower panel 1130 in the current aspect. The connection aperture 1610 can define a first vertical end 1612 and a second vertical end 1614 as well as a first lateral end 1616 and a second lateral end 1618. In the current aspect, the second vertical end 1614 can be straight and can also be termed a stop end, as can be described in greater detail later.

Figure 2:
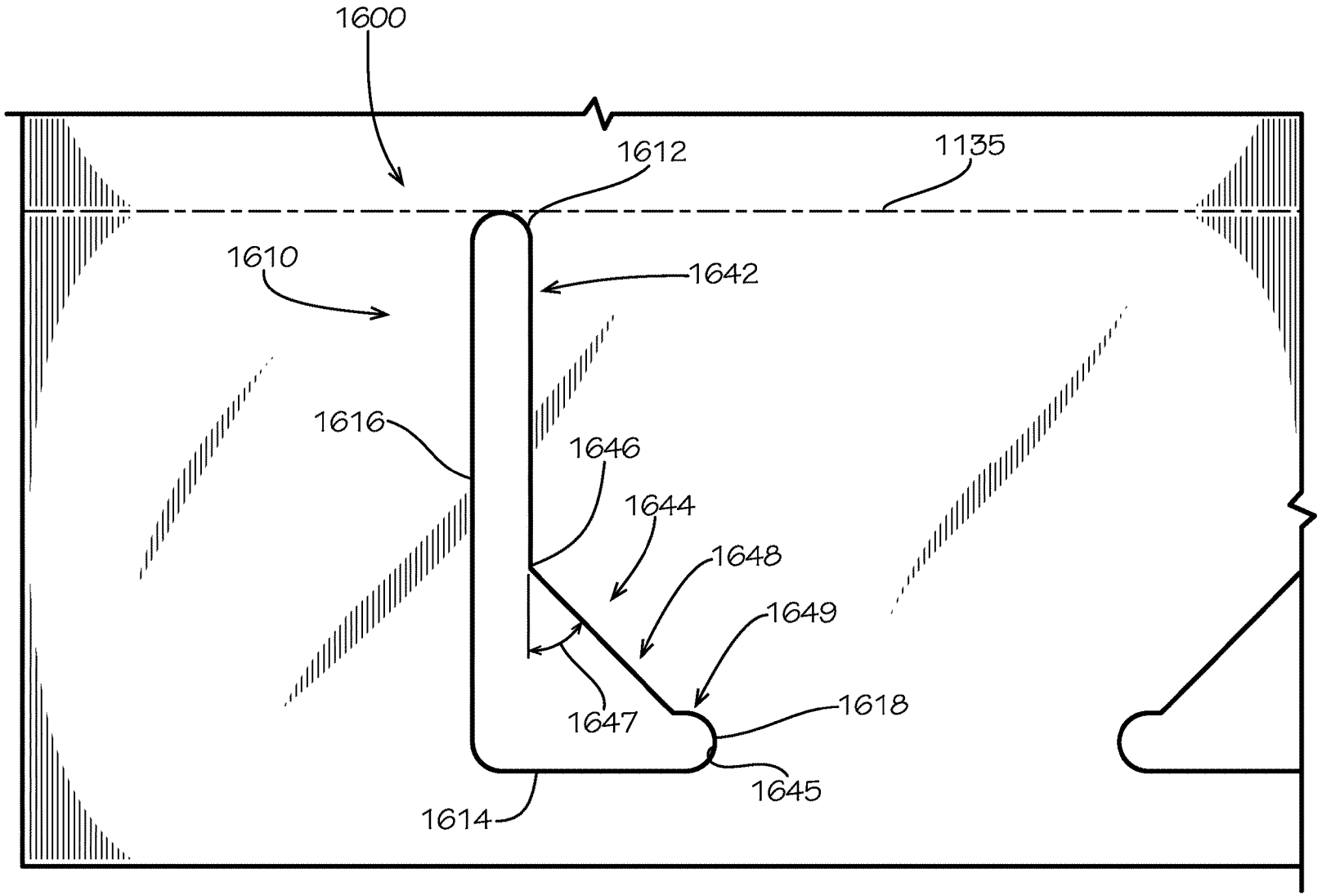
FIG. 2 is a detail view of a panel of the blank as annotated by detail 2 in FIG. 1.

As seen with respect to the detail view of FIG. 2, the connection aperture 1610 can define an elongate aperture having an opening larger on one side than on the other in the current aspect. The connection aperture 1610 can include a slim portion 1642 and an expanded portion 1644. In the current aspect, the slim portion 1642 can extend from the first vertical end 1612 along a length of the connection aperture 1610. Along the slim portion 1642, the first lateral end 1616 can be about parallel to the second lateral end 1618 to define an opening of about constant width. At an inflection point 1646, the second lateral end 1618 can initiate the expanded portion 1644 by defining an angle 1647 with respect to the slim portion 1642. The portion of the expanded portion 1644 defined along the angle 1647 can be referred to as the angled portion 1648 of the expanded portion 1644. In the current aspect, the angle 1647 can be about 45°. The expanded portion 1644 can also define a notch 1645 that can extend in a lateral direction from the angled portion 1648, thereby defining a notched portion 1649 of the expanded portion 1644 that can terminate at a lateral-most extent of the second lateral end 1618. Various corners of the connection aperture 1610 can be rounded as shown to reduce potential for tears or cracks along their features. However, one of skill in the art would understand that these features need not be rounded to accommodate the scope of the current disclosure. As can be seen, the first vertical end 1612 can become tangent to or coincident with the score line 1135 in various aspects, although the first vertical end 1612 need not touch the score line 1135.

With returning reference to FIG. 1, it would be understood by one of skill in the art that the various receiving connection features 1600 and connection apertures 1610 can be rearranged without departing from the scope of the current disclosure. Although the receiving connection features 1600 that are disclosed within the current disclosure are similarly situated, one of skill in the art would understand that combinations of various arrangements of receiving connection features 1600 can be made without departing from the scope of the current disclosure. In various applications, the connection apertures 1610 can be arranged in mirrored or rearranged relationship, and one of skill in the art would readily understand that the features of the connection apertures 1610 remain regardless of the orientation.

Each connection aperture 1610 on the lower panel 1130 can be arranged on one side of the lower panel 1130. A reference line 1131 can be seen to annotate a bisection of the lower panel 1130 showing each connection aperture 1610 on one side of the lower panel 1130. In the current aspect, each connection aperture 1610 can be closer to the reference line 1131 for the center of the lower panel 1130 than to an edge of the lower panel 1130 and can be mirrored relative to each other across the reference line 1131. The second lateral end 1618 can be positioned closest to the reference line 1131 and the first lateral end 1616 can be positioned distal from the reference line 1131.

The upper panel 1220 of the current aspect can comprise another receiving connection feature 1600. In the current aspect, the receiving connection feature 1600 of the upper panel 1220 can comprise a connection aperture 1610. The connection aperture 1610 can include the first vertical end 1612 tangent to the score line 1225.

The lower panel 1230 can comprise at least one attaching connection feature 1700. The attaching connection feature 1700 in the current aspect can comprise at least one connecting tab 1710 in arrangement with at least one support tab 1720, although various aspects can include various arrangements of features. The lower panel 1230 can also comprise a score line 1730 that can be utilized as part of the attaching connection feature 1700, as will be discussed in greater detail later.

Figure 3:
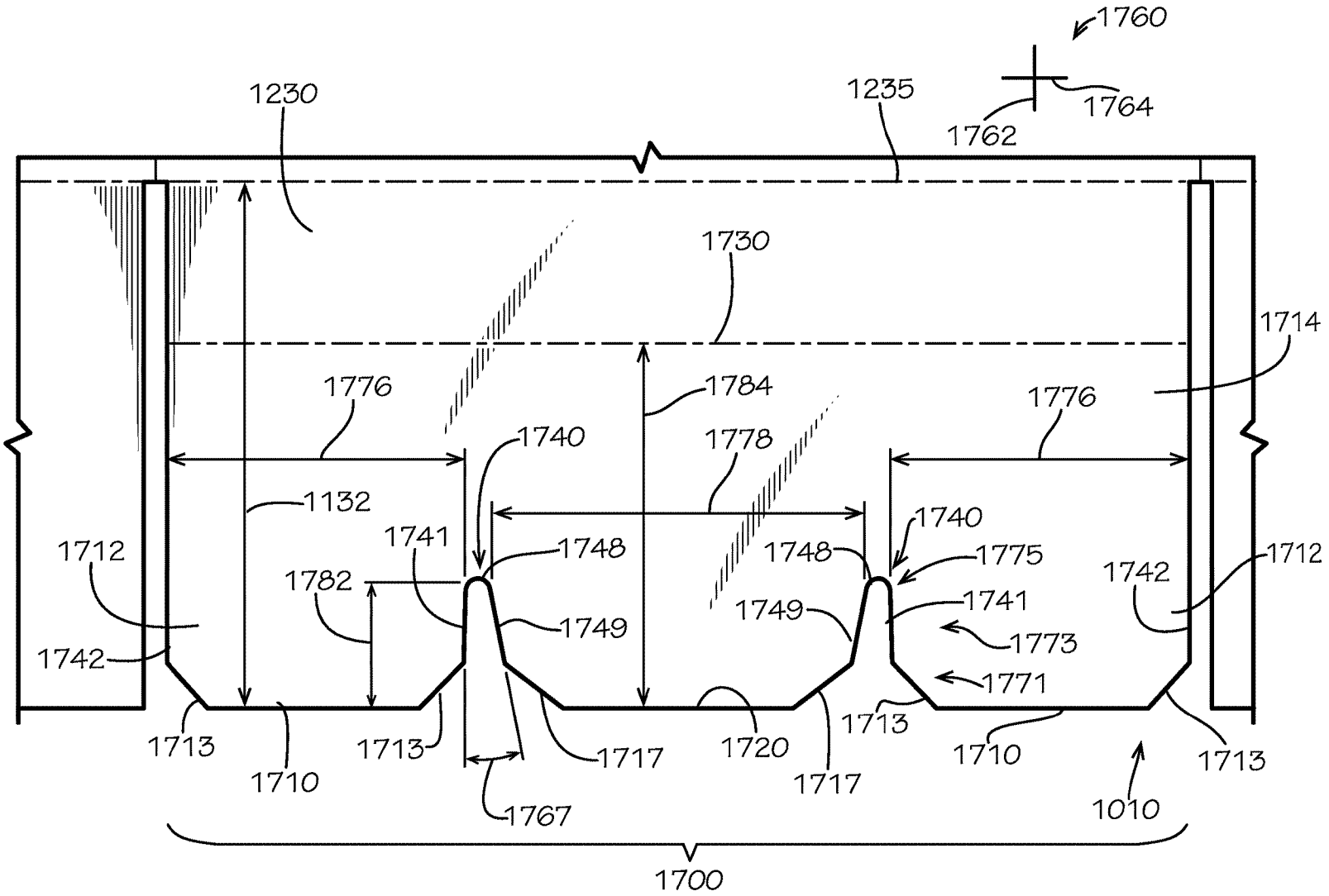
FIG. 3 is a detail view of a panel of the blank as annotated by detail 3 in FIG. 1.

As seen with reference to FIG. 3, each connecting tab 1710 can comprise an extended portion 1712 that can extend from a main body 1714 of the lower panel 1230. In the current aspect, the extended portion 1712 can extend less than half of the vertical dimension 1132, although various aspects can be provided in various arrangements. Additionally, the score line 1730 can be arranged less than half of the vertical dimension 1132 away from the score line 1235. Each connecting tab 1710 can define at least one chamfer 1713. In the current aspect, each connecting tab 1710 can define two chamfers 1713. The chamfers 1713 can be arranged at about 45° angles, although in various aspects various angles may prove advantageous. In the current aspect, the chamfers 1713 can aid in assembly of the box 2000 from the blank 1000. Similarly, each support tab 1720 can comprise chamfers 1717. Chamfers 1717 can be arranged at angles greater than 45°—and, in some aspects, as great as 60°. In various aspects, the chamfers 1717 can be arranged at 45° or less or may be omitted altogether within the scope of the current disclosure. In the current aspect, each connecting tab 1710 can comprise parallel sides 1741, 1742, although in various aspects the sides 1741, 1742 can be angled. Additionally, as shown, the distance between the chamfers 1717 can be greater than the distance between the chamfers 1713, and the support tab 1720 can therefore be wider proximate to the bottom end 1010 than the connecting tabs 1710, thereby strengthening the support provided by the support tab 1720.

A recess 1740 can be defined between each of the connecting tabs 1710 and the support tab 1720. Each recess 1740 can be defined by side 1741 of one connecting tab 1710 and by a side 1749 of the support tab 1720. The support tab 1720 can thereby taper towards the bottom end 1010. The sides 1741 can be connected to sides 1749 in defining the recess 1740 by a radius 1748 along and defining the inner end of the recess 1740. The chamfers 1713, 1717 and the arrangement of the sides 1741, 1749 can provide a locating feature to aid in assembling the box 2000 (discussed later) from the blank 1000.

A reference coordinate system 1760 can be seen in FIG. 3. The reference coordinate system 1760 can be defined by a vertical direction 1762 and a lateral direction 1764. As referenced elsewhere in this disclosure, terms such as "vertical" and "lateral," where used to refer to directionality, can be interpreted to refer generally to the directions identified using reference coordinate system 1760.

In general, sides 1741 can be arranged in relationship about parallel to the vertical direction 1762. Sides 1749 of the support tab 1720 can be angled—as represented by angle 1767—at about 30° with reference to the vertical direction 1762 and with reference to sides 1741 in various aspects, although in various aspects the sides 1749 can be parallel to sides 1741 and in various aspects the sides 1749 can be between 15° and 45°. Because of the arrangement of the angle 1767, the recess 1740 can be defined by a tapering arrangement such that the recess 1740 can become narrower along its length. The narrowing feature can improve engagement when in an assembled state.

The recess 1740 can be defined of three distinct portions. Initially, a mouth 1771 can comprise the region of the recess 1740 proximate to and defined by the chamfers 1717, 1713. A taper 1773 can define the region of the recess 1740 proximate to and defined by the sides 1741, 1749, as previously described. Finally, an end 1775 can define the portion of the recess 1740 proximate to and defined by the radius 1748. In various aspects, the mouth 1771 can be of about the same length as measured parallel to the vertical direction 1762 as the taper 1773.

Each connecting tab 1710 can be of a width 1776 as measured parallel to the lateral direction 1764. The width 1776 can be measured from side 1741 to side 1742. Additionally, the support tab 1720 can be of a width 1778 as measured from a lateral-most point of the first side 1749 to the lateral-most point of the second side 1749. The lateral-most points of each side are the points at which the radii 1748 end and the sides 1749 begin. In the current aspect, the width 1776 can bout 75% of the width 1778. In various aspects, the width 1776 can be between 70% and 80% of the width 1778. In various aspects, the width 1776 can be 65% to 105% of the width 1778.

Each recess 1740 can be arranged to be defined into the lower panel 1230 at a distance 1782. The distance 1782 can be defined as a length measured parallel to the vertical direction 1762. In various aspects, the distance 1782 can be about one-fourth of the vertical dimension 1132. In various aspects, the distance 1782 can be less than one-fifth of the vertical dimension 1132. Further, the distance 1782 can be less than one-half of a distance 1784 as measured parallel to the vertical direction 1762 from the bottom end 1010 of the lower panel 1230 to the score line 1730. Such arrangement can be beneficial to maintain the structural integrity of the lower panel 1230 while also providing the ability of the customer to assemble the box 2000 (discussed later).

With returning reference to FIG. 1, the upper panel 1320 can be of substantially similar arrangement to lower panel 1230. In the current aspect, the upper panel 1320 can comprise at least one attaching connection feature 1700 including a plurality of connecting tabs 1710 and at least one support tab 1720. Similarly, the lower panel 1430 can be of substantially similar arrangement to lower panel 1230. In the current aspect, the lower panel 1430 can comprise at least one attaching connection feature 1700 including a plurality of connecting tabs 1710 and at least one support tab 1720.

The lower panel 1330 can be of substantially similar arrangement to lower panel 1130. In the current aspect, the lower panel 1330 can comprise at least one receiving connection feature 1600, which can include at least one connection aperture 1610. In the current aspect, the at least one connection aperture 1610 can comprise two connection apertures 1610 in substantially the same arrangement as lower panel 1130. Similarly, the upper panel 1420 can be of substantially similar arrangement to upper panel 1220. The upper panel 1420 of the current aspect can comprise at least one receiving connection feature 1600. In the current aspect, the receiving connection feature 1600 of the upper panel 1420 can comprise a connection aperture 1610. In the current aspect, the arrangement of the connection aperture 1610 can be arranged in a mirror arrangement to the upper panel 1220.

The view of FIG. 1 shows an inner side of the blank 1000. As can be seen, upper panels 1120, 1220, 1320, 1420 can include inner surfaces 1128, 1228, 1328, 1428, respectively. Central panels 1110, 1210, 1310, 1410 can include inner surfaces 1118, 1218, 1318, 1418, respectively. Lower panels 1130, 1230, 1330, 1430 can include inner surfaces 1138, 1238, 1338, 1438, respectively.

Figure 4:
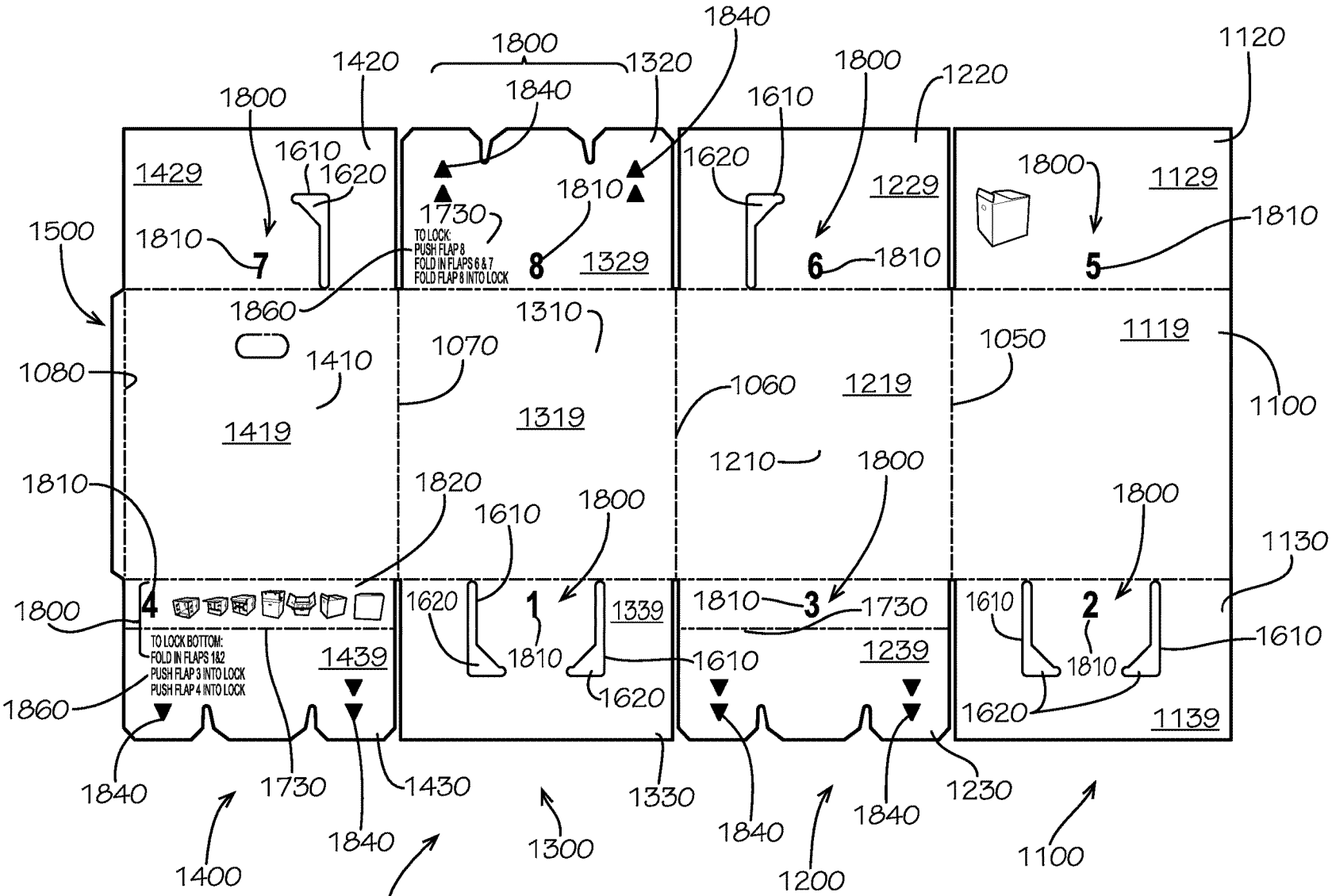
FIG. 4 is a plan view of an outer side of the blank of FIG. 1.

As seen with reference to FIG. 4, an outer side of the blank 1000 can be seen. As can be seen, upper panels 1120,

1220, 1320, 1420 can include outer surfaces 1129, 1229, 1329, 1429, respectively. Central panels 1110, 1210, 1310, 1410 can include outer surfaces 1119, 1219, 1319, 1419, respectively. Lower panels 1130, 1230, 1330, 1430 can include outer surfaces 1139, 1239, 1339, 1439, respectively.

The outer side of the blank 1000 can comprise reference instructions 1800. Reference instructions 1800 can be utilized to provide an instruction set to someone forming the box 2000 from the blank 1000. The reference instructions 1800 can comprise reference numerals 1810 that can provide an order of operations to form the box 2000. The reference instructions 1800 can comprise a reference procedure 1820 that can be produced as a guide for forming the box 2000. The reference instructions 1800 can comprise arrows 1840 to show directionality for forming the box 2000. The reference instructions 1800 can comprise written instructions 1860 for forming the box 2000. The blank 1000 can comprise aperture covers 1620 formed in and covering each connection aperture 1610.

Figure 5:
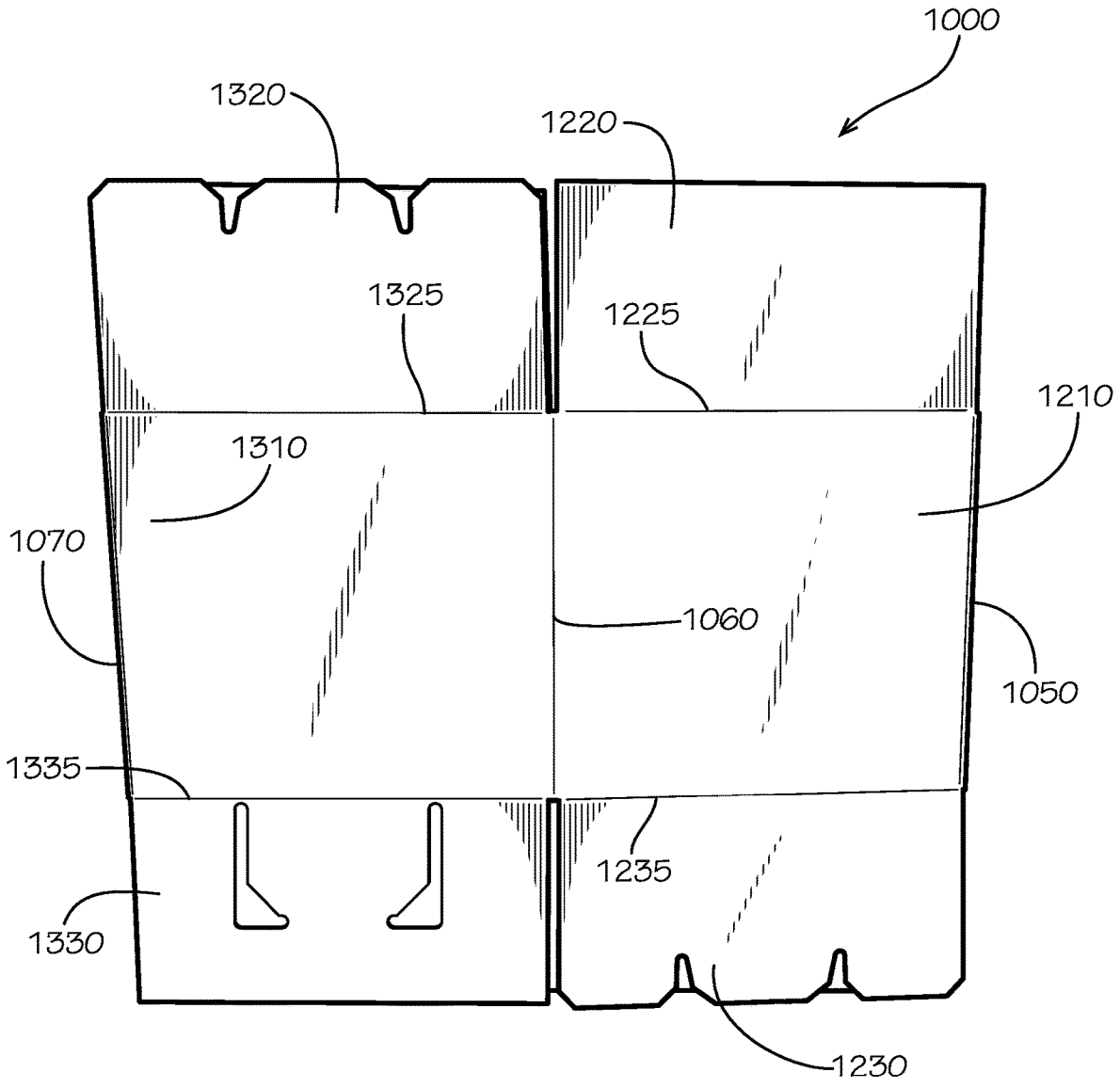
FIG. 5 is a side view of the blank of FIG. 1. in a pre-assembled, flattened arrangement.

In commerce, the blank 1000 can be provided to the customer with the connection panel 1500 connected to the central panel 1110. Connection can be achieved by adhesive to either the outer surface 1119 or the inner surface 1118. Connection can be arranged by bending the main panel 1300 with respect to main panel 1200 along score line 1060 and bending the connection panel 1500 with respect to main panel 1400 along score line 1080. As such, the blank 1000 can be supplied to the consumer in pre-assembled, flattened arrangement with the connection panel 1500 adhered to or connected to the central panel 1110 as seen with reference to FIG. 5. In various aspects, connections can be achieved using mechanical fasteners, mechanical arrangements, integrated fabrication, or various other connection techniques. In various aspects, the blank 1000 can be provided to the customer in pre-assembled, non-flattened arrangement.

Figure 6A:
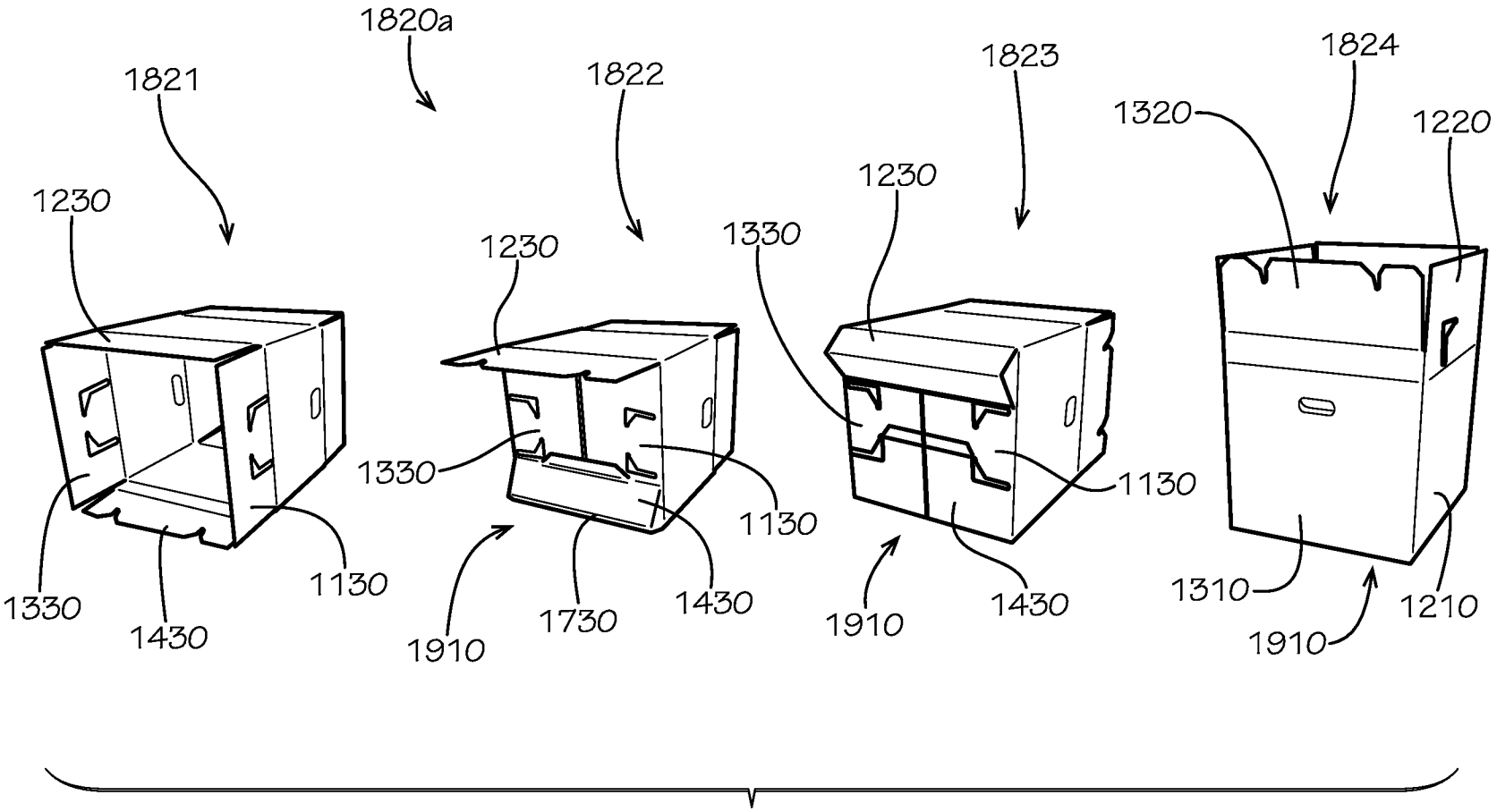
FIG. 6A is a detail view of a portion of a reference procedure produced on an outer side of the blank as shown in FIG. 4.
Figure 6B:
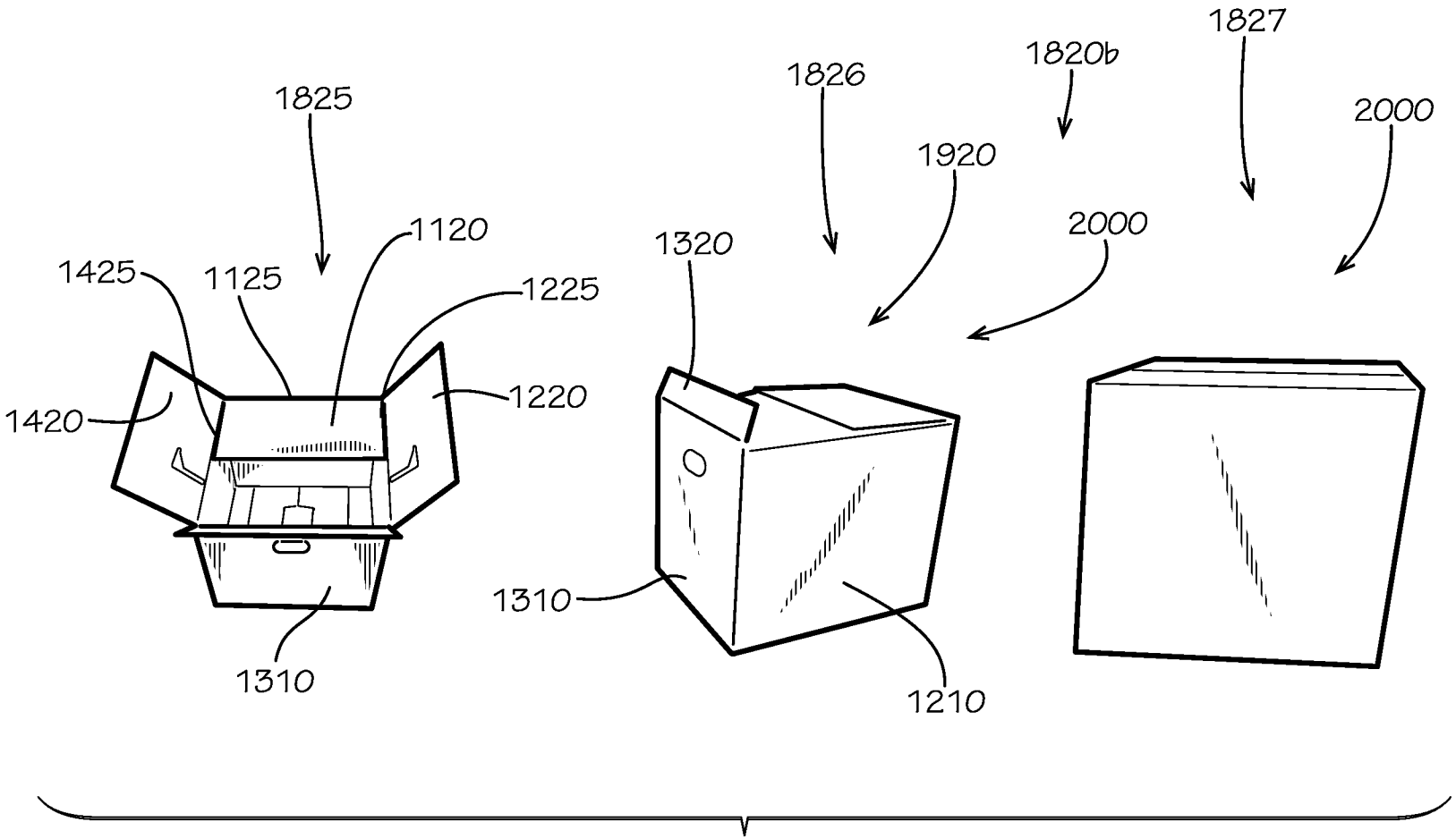
FIG. 6B is a detail view of a portion of a reference procedure produced on an outer side of the blank as shown in FIG. 4.

The reference procedure 1820 as can be produced on the blank 1000 can be seen with reference to FIGS. 6A-6B. For ease of viewing, the reference steps are shown as reference procedure 1820*a* and 1820*b*, together composing reference procedure 1820. A first reference step 1821 can comprise arranging the blank 1000 in an expanded arrangement such that the blank 1000 can become a pre-assembled, non-flattened structure. This can comprise bending the blank 1000 along score line 1050 and score line 1070 and unbending the blank along score lines 1060 and 1080 such that blank can be arranged in a box-like arrangement but without the ends in arrangement. A second reference step 1822 can comprise the steps of folding the two lower panels 1130, 1330 along score lines 1135, 1335, respective, to form a bottom 1910. Another view of the bottom 1910 can be seen with reference to FIG. 6C.

With returning reference to FIG. 6A, the second reference step 1822 can also comprise the step of folding the lower panel 1430 along the score line 1730 so that the attaching connection feature 1700 can be connected to the receiving connection feature 1600. In the current aspect, connecting the attaching connection feature 1700 to the receiving connection feature 1600 can comprise inserting each connecting tab 1710 into each connection aperture 1610. Following insertion, the lower panel 1430 can be flattened such that the fold along score line 1730 can be flattened and the fold along score line 1435 can be increased. A third reference step 1823 can comprise the same procedure as the second reference step 1822 but with respect to the attaching connection feature 1700 of lower panel 1230 connecting to the receiving connection feature 1600. One of skill in the art would note that, in the current aspect, each connecting tab 1710 can be inserted into one connection aperture 1610 such that there is a 1:1 relationship between these features, although in various aspects the arrangements can be modified. Additionally, one connecting tab 1710 of one attachment connection feature 1700 can contact one connection aperture 1610 of one receiving connection feature 1600 and one connecting tab 1710 of the same attachment connection feature 1700 can contact one connection aperture 1610 of a different receiving connection feature 1600 such that the attachment connection feature 1700 of each lower panel 1230, 1430 contacts the receiving connection feature 1600 of each lower panel 1130, 1330. In this way, the lower panels 1130, 1230, 1330, 1430 can become connected together.

Because of the arrangement of the various features, the attachment of the lower panels 1130, 1230, 1330, 1430 together can resist pullout and opening of the bottom 1910, providing structure by way of the integrity of the corrugated cardboard. In the arrangement as shown and referenced in the second reference step 1822 and the third reference step 1823, the sides 1741 (see FIG. 3) can interact with the second vertical ends 1614 (see FIG. 2). In this way, the second vertical ends 1614 can become stop ends (as previously referenced) to prevent motion of the various panels when connected. Each of the lower panels 1130, 1330 can be arranged such that the rotation along the score line 1135, 1335, respectively, can be the only motion of the lower panels 1130, 1330. Because of the interaction of the sides 1741 with the second vertical ends 1614, the stiffness of the corrugated cardboard (or whatever material is utilized to comprise the blank 1000) can prevent motion of the lower panels 1130, 1330, thereby maintaining the shape without adhesive or other structural fastening. Additionally, the lower panels 1230, 1430 can provide additional thickness to the region, thereby increasing the overall strength. A fourth reference step 1824 can comprise arranging the mid-assembly of the box 2000 to rest on the bottom 1910.

Figure 6C:
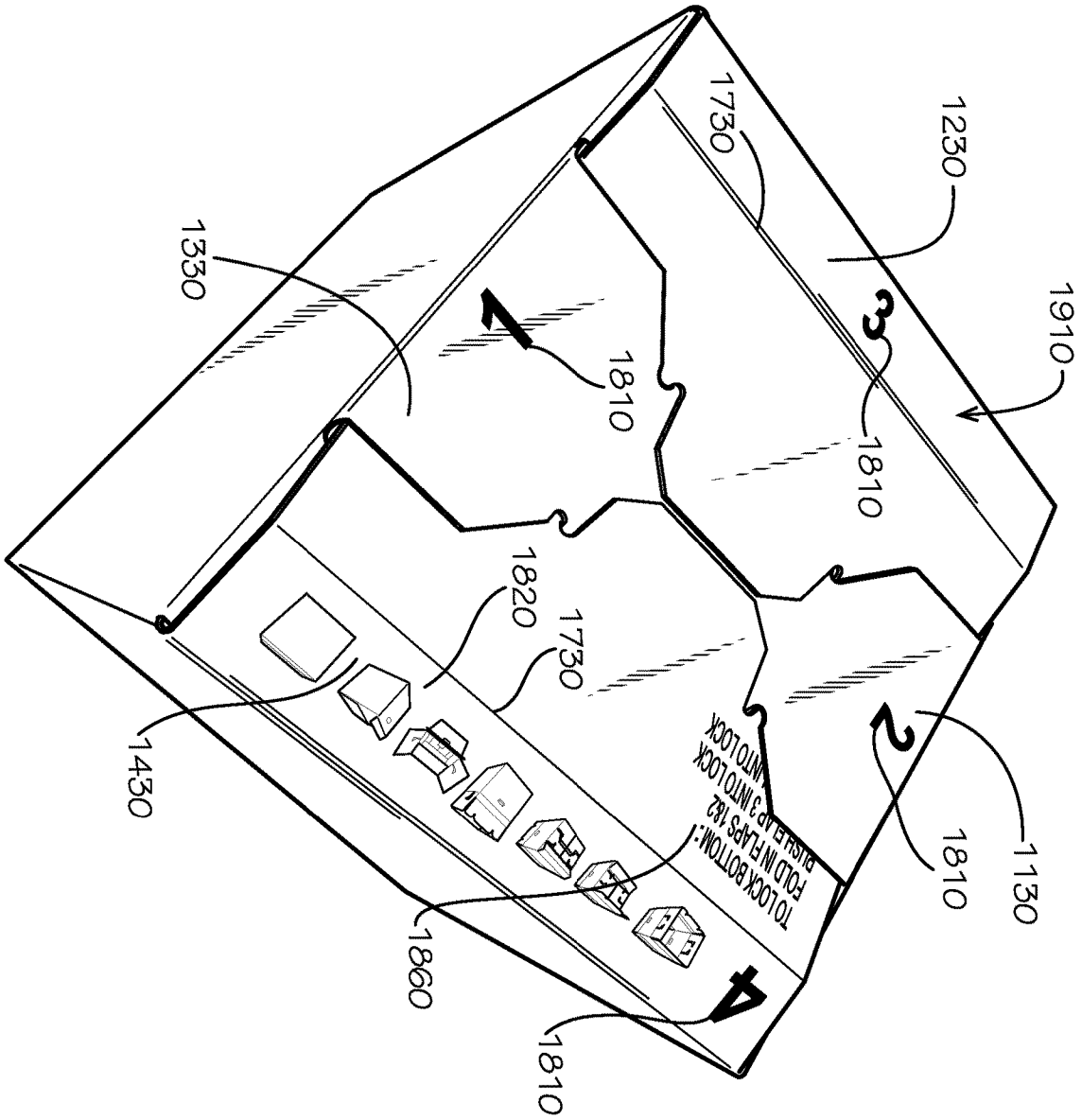
FIG. 6C is a perspective view of a bottom of a box formed from the blank of FIG. 1.
Figure 6D:
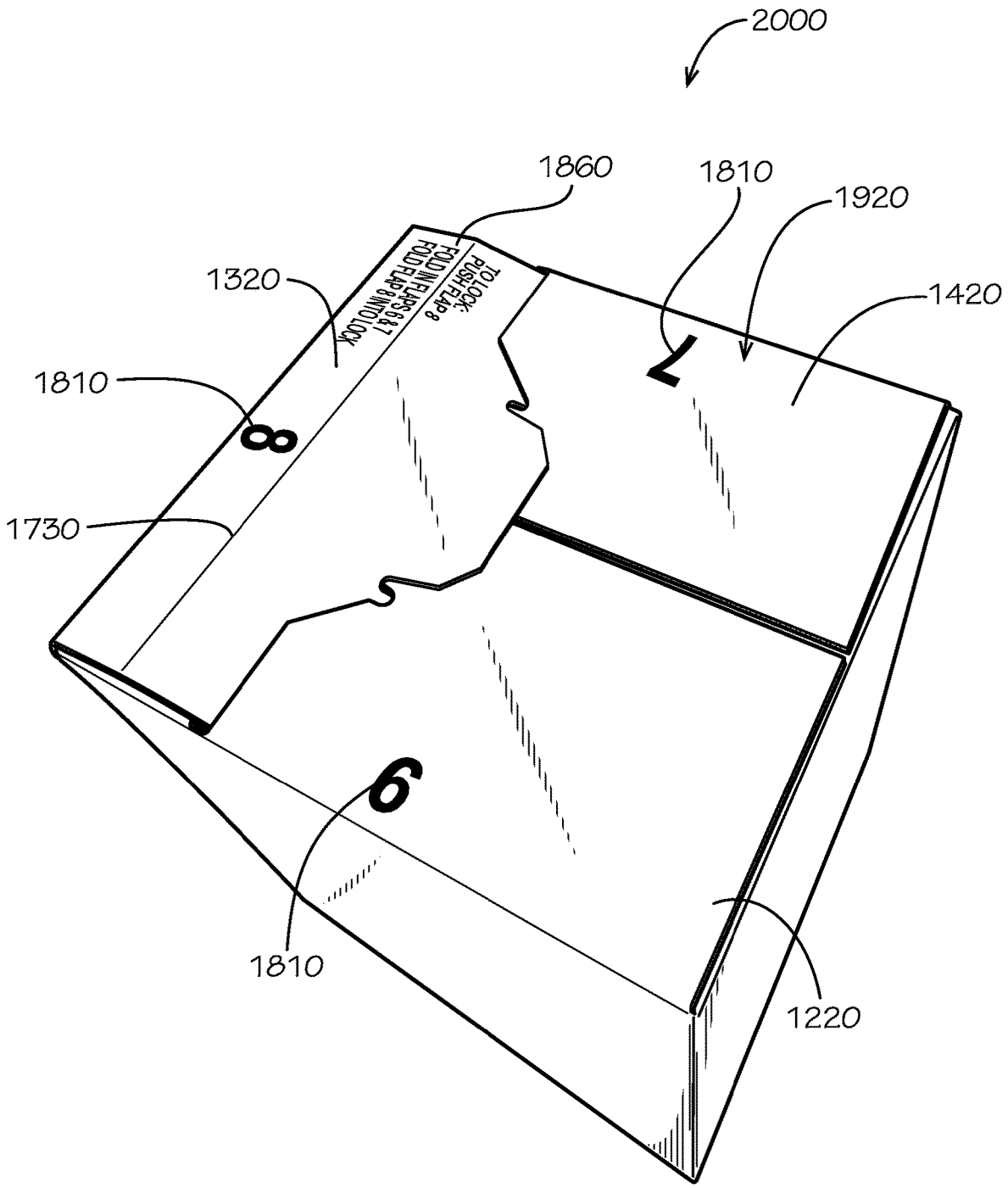
FIG. 6D is a perspective view of a top of the box formed from the blank of FIG. 1.

With reference to FIG. 6B, a fifth reference step 1825 is shown. In the fifth reference step 1825, the upper panel 1120 can be folded along score line 1125. A sixth reference step 1826 can comprise folding the upper panels 1220, 1420 along score lines 1225, 1425, respectively. The upper panel 1320 can be folded similarly to described with reference to the second reference step 1822 to connect the attaching connection feature 1700 of the upper panel 1320 to the receiving connection features 1600 of the upper panels 1220, 1420. By connecting the various parts of the upper panels 1120, 1220, 1320, 1420, the parts can define a top 1920 of the box 2000 as formed from the blank 1000. The seventh reference step 1827 displays the completed box 2000. The completed top 1920 can be seen with reference to FIG. 6D. With reference to FIG. 6C-6D, the reference numerals 1810 can be seen after forming the box 2000. In the current aspect, the top 1920 only has one upper panel 1320 that defines a connection feature 1700 because the top 1920 will not be under as much of a load as the bottom 1910 when the box 2000 is filled.

As a result of the features disclosed herein, the box 2000 can be formed from the blank 1000 without tape, adhesive, mechanical fasteners, or any other attachment methods aside from the mechanical interaction of the features of the blank 1000. Specifically, the attaching connection features 1700 and the receiving connection features 1600 can provide a secure and structurally sound attachment mechanism, omitting the need for additional connection means. As such, the box 2000 can be termed "fastener-free," as the consumer need not include additional fasteners—specifically tapes—to maintain the structural integrity of the box 2000 and to secure the contents. One of skill in the art would understand that the inclusion of fastening means would not depart substantially from the scope of the current disclosure.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A blank for forming packaging, the blank comprising:
a first main panel;
a second main panel connected to the first main panel;
a third main panel connected to the second main panel;
a fourth main panel connected to the third main panel; and
a connection panel connected to the fourth main panel,
each main panel further comprising at least one upper panel, at least one central panel, and at least one lower panel,
wherein at least one upper panel comprises an attaching connection feature,
wherein at least one lower panel comprises an attaching connection feature,
wherein at least one upper panel comprises a receiving connection feature,
wherein at least one lower panel comprises a receiving connection feature,
wherein each main panel defines an inner surface and an outer surface, wherein reference instructions are printed on the outer surface, and
wherein the reference instructions comprise reference numerals, the reference numerals indicating an order of operations to form the packaging from the blank,
wherein at least one attaching connection feature comprises a connecting tab and wherein at least one receiving connection feature comprises a connection aperture, wherein the connection aperture is defined in the panel containing the receiving connection feature,
wherein each connection aperture comprises a slim portion and an expanded portion, wherein the connection aperture defines a first lateral end, a second lateral end, a first vertical end, and a second vertical end,
wherein at least one of the first vertical end and the second vertical end is a stop end,
wherein two upper panels each define only one connection aperture;
wherein one upper panel comprises two connecting tabs and a support tab located between the connecting tabs,
wherein each of the connecting tabs and the support tab define chamfers at outer ends of the tabs,
wherein a recess is defined between each of the connecting tabs and the support tab,
wherein each upper panel is connected to one main panel by a score line,
wherein the outer end of each connecting tab and the support tab is a vertical dimension from the score line, and
wherein the vertical dimension for each connecting tab and the support tab is the same.

2. The blank of claim 1, wherein the expanded portion is defined by an angled portion of one of the first lateral end and the second lateral end.

3. The blank of claim 2, wherein each connection aperture defines a notch laterally beyond the expanded portion.

4. The blank of claim 1, wherein the expanded portion is defined proximate one of the first vertical end and the second vertical end, wherein the expanded portion further defines a notch proximate one of the first lateral end and the second lateral end.

5. The blank of claim 1, wherein each connecting tab defines a first side and a second side, wherein the first side and second side are about parallel.

6. The blank of claim 5, further comprising a support tab arranged adjacent to at least one connecting tab.

7. The blank of claim 6, each support tab comprising at least one side, wherein at least one side of the support tab and at least one side of the connecting tab together define a recess between the support tab and the connecting tab, wherein at least one side of the connecting tab is sized to interact with the stop end.

8. The blank of claim 1, wherein each upper panel and each lower panel comprises one of the reference numerals, and wherein at least one panel comprises graphics displaying the stages of assembly.

9. The blank of claim 1, wherein the four main panels define only two apertures, wherein the two apertures comprise one handle cutout on one main panel and another handle cutout on another main panel.

10. The blank of claim 1, wherein one upper panel defines a rectangular shape.

11. The blank of claim 1, wherein each side of each support tab is angled with respect to sides of each adjacent connecting tab.

12. The blank of claim 11, wherein the angle is about 30°.

* * * * *